US012768277B2

(12) United States Patent
Zhang et al.

(10) Patent No.: US 12,768,277 B2
(45) Date of Patent: Oct. 20, 2026

(54) AXIAL COMPRESSOR INTEGRATED BLADED ROTOR AIRFOIL DESIGN SCHEME

(71) Applicant: Pratt & Whitney Canada Corp., Longueuil (CA)

(72) Inventors: Chao Zhang, Vaughan (CA); Rambod Larijani, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 18/967,079

(22) Filed: Dec. 3, 2024

(65) Prior Publication Data

US 2026/0153032 A1 Jun. 4, 2026

(51) Int. Cl.
*F01D 5/30* (2006.01)

(52) U.S. Cl.
CPC ..... *F01D 5/30* (2013.01)

(58) Field of Classification Search
CPC ..... F01D 5/30; F01D 5/34
See application file for complete search history.

(56) References Cited

U.S. PATENT DOCUMENTS

| | | | |
|---|---|---|---|
| 6,471,474 B1 | 10/2002 | Mielke et al. | |
| 10,876,410 B2 | 12/2020 | Mahle et al. | |
| 11,939,885 B2 | 3/2024 | Spanrad | |
| 2016/0208626 A1 | 7/2016 | Fink et al. | |
| 2022/0186622 A1* | 6/2022 | Lecuyer | F01D 9/02 |
| 2023/0037206 A1* | 2/2023 | Hirata | F01D 5/145 |
| 2023/0043965 A1* | 2/2023 | Stone | F01D 5/34 |
| 2024/0240564 A1 | 7/2024 | Hanschke et al. | |

FOREIGN PATENT DOCUMENTS

| | | |
|---|---|---|
| DE | 102013219814 B3 | 11/2014 |
| EP | 3045663 A1 | 7/2016 |
| EP | 3431713 A1 | 1/2019 |

OTHER PUBLICATIONS

Extended European Search Report corresponding to EP Application No. 25220404.5; Issue date, May 7, 2026, 8 pages.

* cited by examiner

*Primary Examiner* — Andrew H Nguyen
(74) *Attorney, Agent, or Firm* — CANTOR COLBURN LLP

(57) ABSTRACT

An integrally bladed rotor (IBR) includes a hub and blades, each blade includes an airfoil section extending from a blade root at the hub to a blade tip defining a radially outboard extent of the rotor blade to aerodynamically interact with a flow of air for compressing the air. A root fillet is integrally formed with the hub the airfoil section integrally extends therefrom. The blade includes a localized increased blade root thickness portion defined based on at least one of an axial thickness of a web portion of the hub and a chord length of the blade.

20 Claims, 4 Drawing Sheets

AXIAL COMPRESSOR INTEGRATED BLADED ROTOR AIRFOIL DESIGN SCHEME

BACKGROUND

The present disclosure relates gas turbine engines and, more particularly, to integrally bladed rotors (IBRs) of gas turbine engines.

A turbine is used to generate power for propulsion, in some cases, by turning propellors, fans or helicopter blades through a gearbox. In a gas turbine engine, fuel and compressed oxygen are combusted in a combustor to produce a high-temperature and high-pressure fluid. This fluid enters a turbine and interacts with rows or stages of turbine blades and vanes. This interaction causes the stages of turbine blades to rotate a shaft. The shaft rotation drives a compressor to compress the oxygen for the combustor and, as noted above, can be used to drive operations of a generator to produce electricity or for propulsion.

Within the compressor, inlet air is partially compressed by flowing through a series of interleaved compressor vane stages and compressor blade stages. The compressor vane stages can be stationary whereas each of the compressor blade stages rotates as a singular element about a rotational axis of the gas turbine engine. In some cases, each compressor blade stage can be provided as an IBR in which a rotor hub and blades as assembled as a single part with the blades being integrally formed with the hub.

BRIEF DESCRIPTION

In one exemplary embodiment, an integrally bladed rotor (IBR) includes a hub and blades, each blade includes an airfoil section extending from a blade root at the hub to a blade tip defining a radially outboard extent of the rotor blade to aerodynamically interact with a flow of air for compressing the air. A root fillet is integrally formed with the hub the airfoil section integrally extends therefrom. The blade includes a localized increased blade root thickness portion defined as a function of at least one of an axial thickness of the hub and a chord length of the blade.

Additionally or alternatively, in this or other embodiments the localized increased blade root thickness portion is located at the blade root.

Additionally or alternatively, in this or other embodiments the localized increased blade root thickness portion is centered on a mid-chord line of the blade.

Additionally or alternatively, in this or other embodiments the localized increased blade root thickness portion is located at a concave side of the blade.

Additionally or alternatively, in this or other embodiments a maximum axial length of the localized increased blade root thickness portion is defined by equation 1.

Additionally or alternatively, in this or other embodiments a maximum percentage increase in blade thickness at the localized increased blade root thickness portion is defined by equation 2.

Additionally or alternatively, in this or other embodiments the localized increased blade root thickness portion is configured to reduce stress concentrations at the root fillet.

In another exemplary embodiment, a compressor assembly of a gas turbine engine, includes one or more compressor rotors arrayed along an engine central longitudinal axis. At least one compressor rotor of the one or more compressor rotors is an integrally bladed rotor (IBR) including a hub and blades, each blade having an airfoil section extending from a blade root at the hub to a blade tip defining a radially outboard extent of the rotor blade to aerodynamically interact with a flow of air for compressing the air. A root fillet is integrally formed with the hub and the airfoil section integrally extends therefrom. The blade includes a localized increased blade root thickness portion defined as a function of at least one of an axial thickness of the hub and a chord length of the blade.

Additionally or alternatively, in this or other embodiments the localized increased blade root thickness portion is located at the blade root.

Additionally or alternatively, in this or other embodiments the localized increased blade root thickness portion is centered on a mid-chord line of the blade.

Additionally or alternatively, in this or other embodiments the localized increased blade root thickness portion is located at a concave side of the blade.

Additionally or alternatively, in this or other embodiments a maximum axial length of the localized increased blade root thickness portion is defined by equation 1.

Additionally or alternatively, in this or other embodiments a maximum percentage increase in blade thickness at the localized increased blade root thickness portion is defined by equation 2.

Additionally or alternatively, in this or other embodiments the localized increased blade root thickness portion is configured to reduce stress concentrations at the root fillet.

In yet another exemplary embodiment, a gas turbine engine includes a turbine driven by products of a combustor, and a compressor operably connected to the turbine and driven by rotation of the turbine. The compressor includes an integrally bladed rotor (IBR). The IBR includes a hub and blades, each blade includes an airfoil section extending from a blade root at the hub to a blade tip defining a radially outboard extent of the rotor blade to aerodynamically interact with a flow of air for compressing the air, and a root fillet integrally formed with the hub and from which the airfoil section integrally extends. The blade includes a localized increased blade root thickness portion defined as a function of at least one of an axial thickness of the hub and a chord length of the blade.

Additionally or alternatively, in this or other embodiments the localized increased blade root thickness portion is located at the blade root.

Additionally or alternatively, in this or other embodiments the localized increased blade root thickness portion is centered on a mid-chord line of the blade.

Additionally or alternatively, in this or other embodiments the localized increased blade root thickness portion is located at a concave side of the blade.

Additionally or alternatively, in this or other embodiments a maximum axial length of the localized increased blade root thickness portion is defined by equation 1.

Additionally or alternatively, in this or other embodiments a maximum percentage increase in blade thickness at the localized increased blade root thickness portion is defined by equation 2.

Additional features and advantages are realized through the techniques of the present disclosure. Other embodiments and aspects of the disclosure are described in detail herein and are considered a part of the claimed technical concept. For a better understanding of the disclosure with the advantages and the features, refer to the description and to the drawings.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
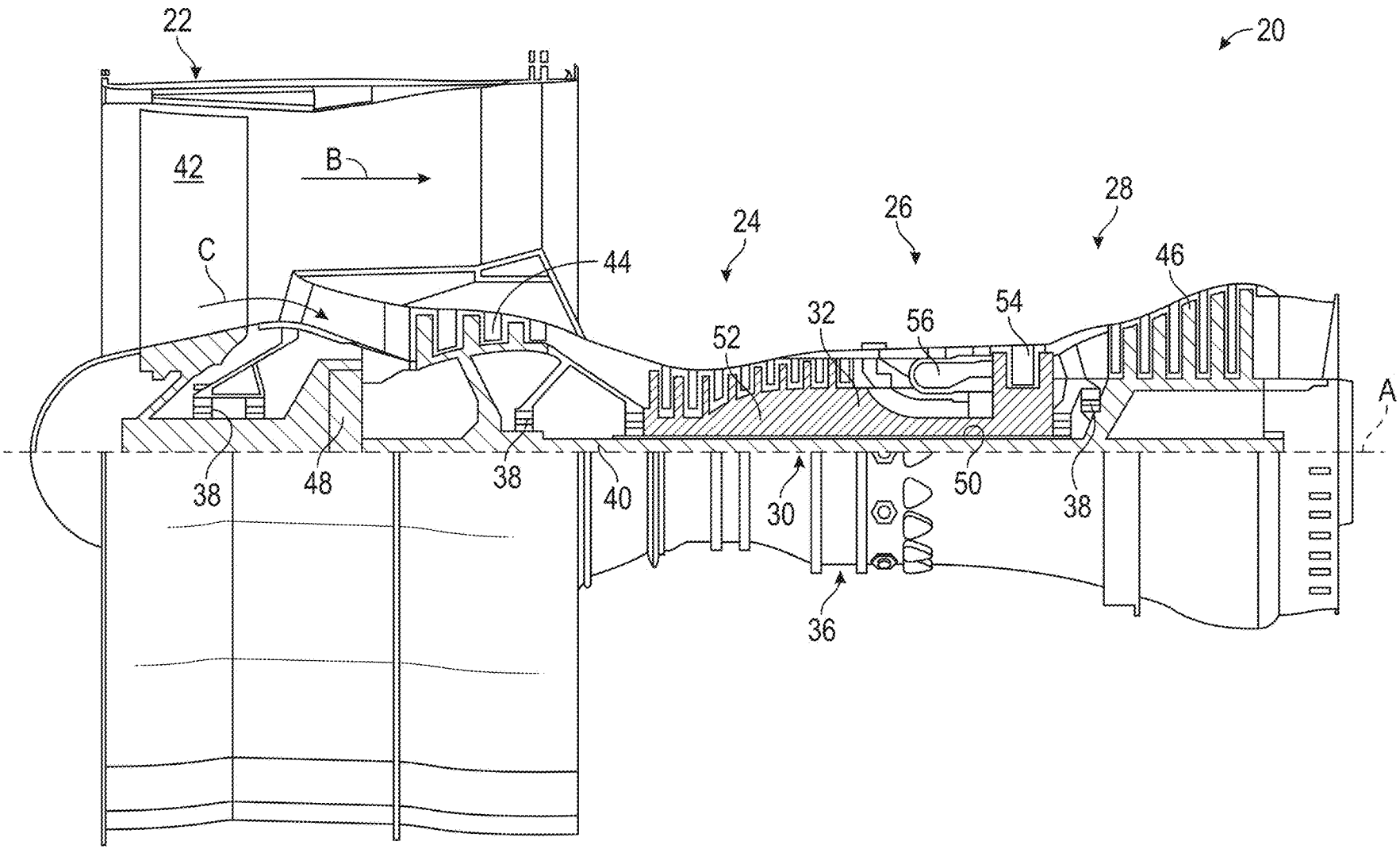
FIG. 1 is a partial cross-sectional view of an exemplary gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary gas turbine engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

Figure 2:
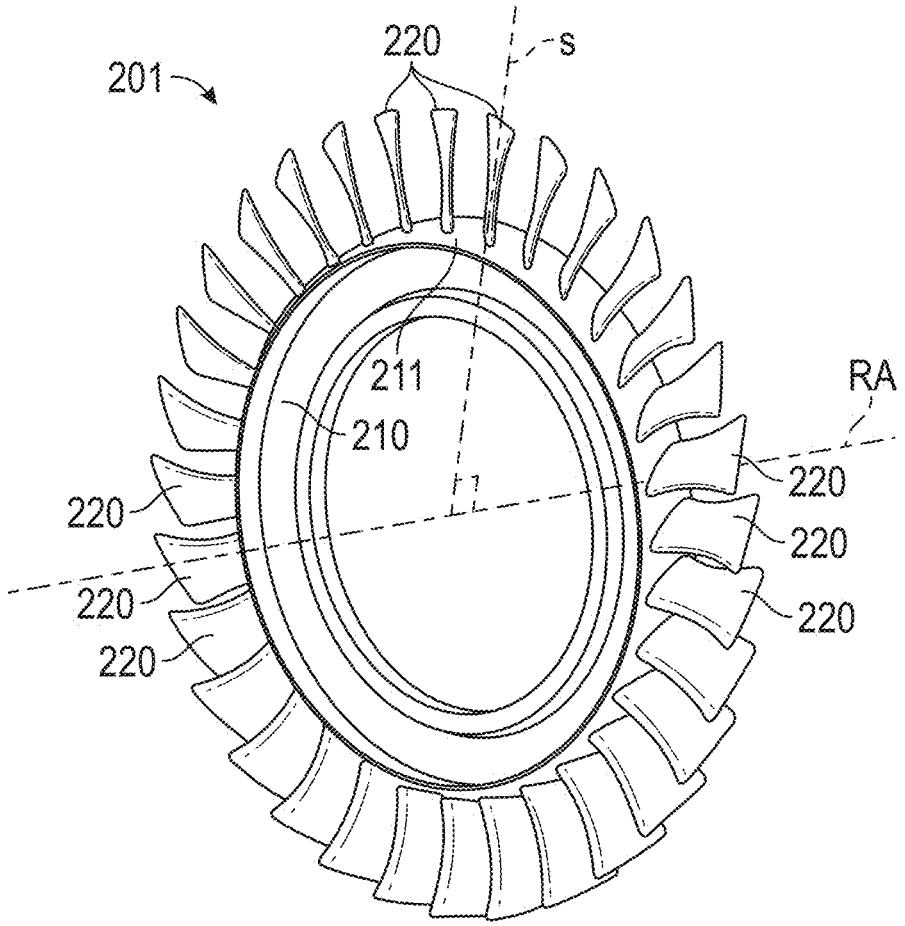
FIG. 2 is a perspective view of an exemplary embodiment of an IBR of a compressor section of the gas turbine engine of FIG. 1.

With reference to FIG. 2, an IBR 201 is provided for use in at least the compressor section 24 of the gas turbine engine 20 of FIG. 1. The IBR 201 includes a hub 210 and non-removable, circumferentially arranged rotor blades (hereinafter referred to as "blades") 220 that radially extend from the hub 210. The blades 220 can be integrally formed with the hub 210 so that the IBR 201 may be devoid of individual releasable blade attachments between the blades 220 and the hub 210. The IBR 201 may be referred to as a blade disk ("blisk") or a bladed ring ("bling"). The hub 210 and the entire IBR 201 may have rotation axis RA and the hub 210 may include a platform 211 defining a part of the core flow path C of FIG. 1. The blades 220 may extend radially outwardly from the platform 211. Exemplary airfoil stacking line S is a reference line designating a position in space of a planar cross sections of a blade 220. The airfoil stacking line S may extend radially from rotation axis RA and may provide a frame of reference for a corresponding one of the blades 220.

Figure 3:
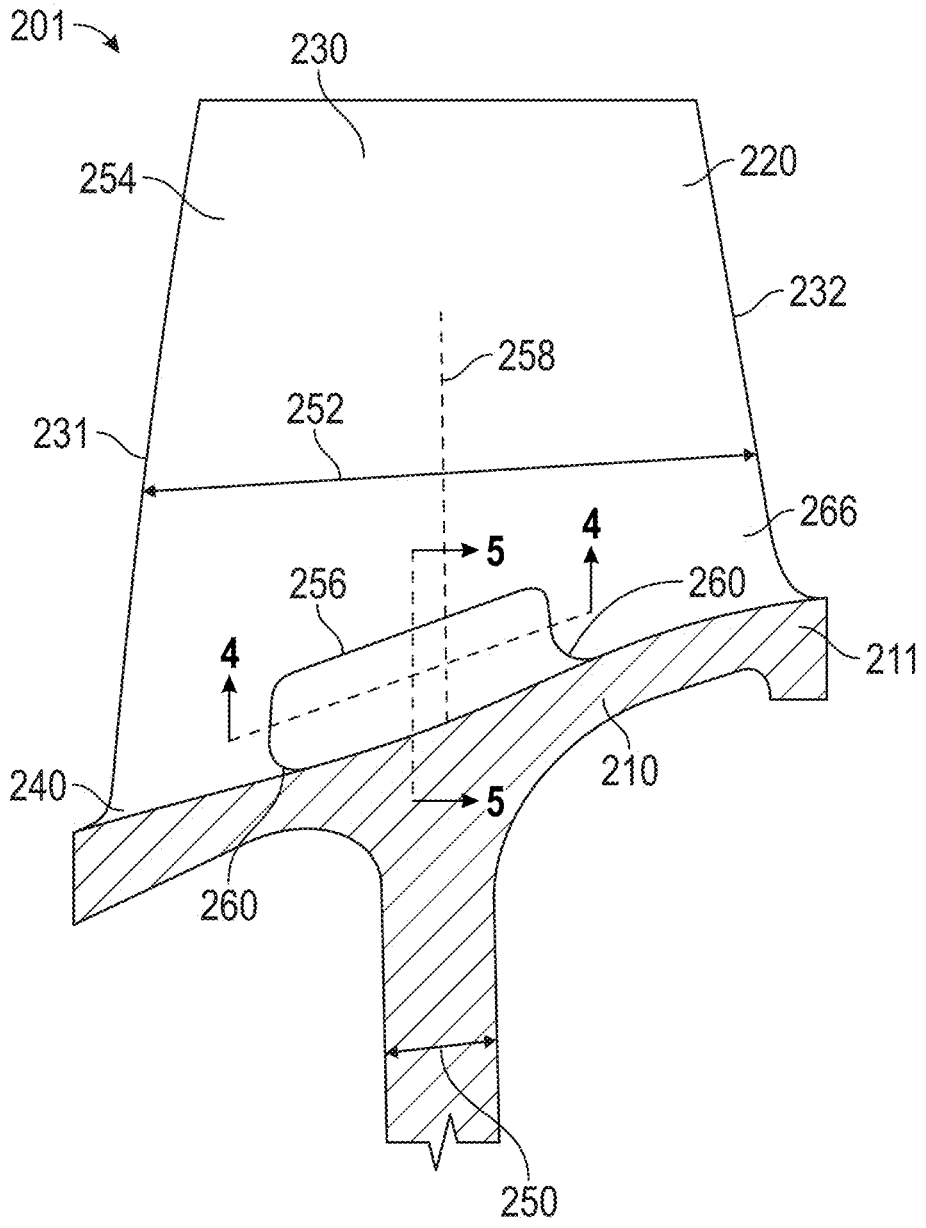
FIG. 3 is a perspective view of an exemplary embodiment of a blade of an IBR.

Referring now to FIG. 3, each of the blades 220 includes an airfoil section 230 to aerodynamically interact with a flow of air for compressing the air, a root fillet 240 integrally formed with the platform 211 of the hub 210 and from which the airfoil section 230 integrally extends along a radial dimension. The airfoil section 230 includes a leading edge 231, a trailing edge 232 and opposed concave (pressure) and convex (suction) surfaces extending between the leading edge 231 and the trailing edge 232. In a typical IBR 201, an axial hub width 250 is much smaller than an axial blade chord length 252 to reduce weight of the IBR 201. As a consequence, centrifugal loads caused by the mass around the leading edge 231 and the trailing edge 232 converge on the platform 211 at or near a mid-chord location, and the stresses at the mid-chord root fillet 256 on the concave side of the blade 220 is significantly higher than the stresses at the leading edge 231 and the trailing edge 232.

To reduce or mitigate this stress concentration at the root fillet 240 of the concave side of the blade 220, the concave surface 254, illustrated in FIG. 3, includes a localized increased blade root thickness portion 256, that in some embodiments, is centered around a mid-chord line 258 of the blade 220. The localized increased blade root thickness portion 256 is further illustrated in the radial cross-sectional view of FIG. 4 and in the chordwise cross-sectional view of FIG. 5.

Figure 4:
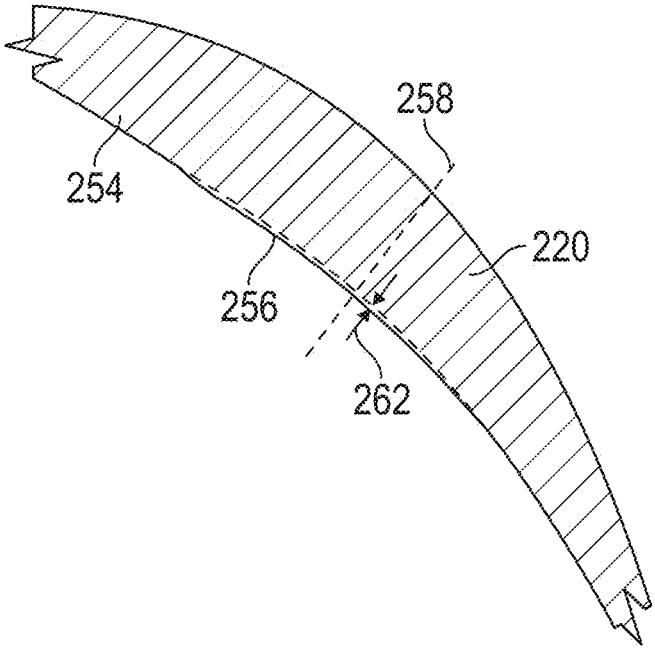
FIG. 4 is a radial cross-sectional view of an embodiment of a blade of an IBR.
Figure 5:
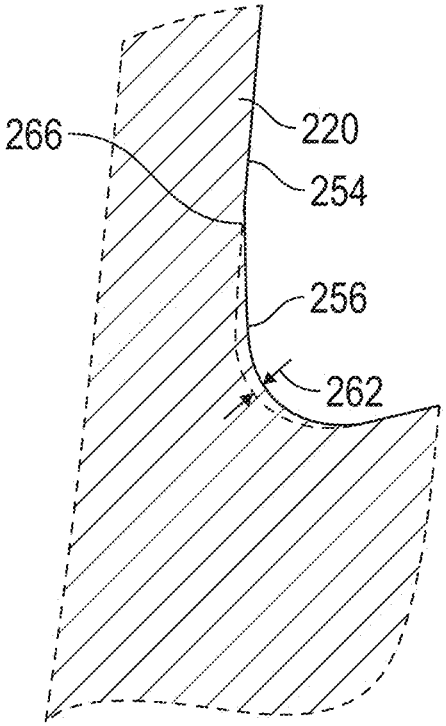
FIG. 5 is a chord-wise cross-sectional view of an embodiment of a blade of an IBR.

The localized mid-chord increased blade root thickness portion 256 has a chordwise extent 260 illustrated in FIG. 3, and a maximum thickness increase 262 illustrated in FIG. 4 and FIG. 5. The chordwise extent 260, defined from the mid-chord location 258, may be calculated from the axial hub width 250 and the chord length of the blade 220 at the blade root 266, as illustrated in equation 1 below:

$$\text{Max Range} = 4W\left(1 - \frac{W}{CL}\right)$$

In equation 1, "W" is the axial hub width 250, and "CL" is the chord length at the root of the blade 220.

Similarly, a maximum amount of increase in the root thickness in the blade root 266 may be calculated from the axial hub width 250 and the chord length of the blade 220 at the blade root 266, as illustrated in equation 2 below:

$$\text{Max Increase } \% = 100\left(1 - \frac{W}{CL}\right)\Big/4$$

The results of Equation 1 and Equation 2 are the maximum range of the localized increased blade root thickness portion 256 from the mid-chord location 258, and the maximum thickness increase as a percentage of a baseline blade thickness at the blade root 266. A range of the localized increased blade root thickness portion 256 may be reduced from these maximum calculated values to achieve a desired stress reduction.

Locally increasing the thickness of the blade root 266 portion of a concave side of the blade 210 acts to reduce the stresses at the mid-chord portion of the blade root 256 and root fillet 240, thereby improving the service life of the IBR 201.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An integrally bladed rotor (IBR), comprising:
a hub; and
blades, each blade comprising:
an airfoil section extending from a blade root at the hub to a blade tip defining a radially outboard extent of the rotor blade to aerodynamically interact with a flow of air for compressing the air; and
a root fillet integrally formed with the hub and from which the airfoil section integrally extends;
wherein the blade includes a localized increased blade root thickness portion having a maximum axial length and a maximum percentage increase in blade thickness defined as a function of an axial thickness of the hub.

2. The IBR of claim 1, wherein the localized increased blade root thickness portion is located at the blade root.

3. The IBR of claim 1, wherein the localized increased blade root thickness portion is centered on a mid-chord line of the blade.

4. The IBR of claim 1, wherein the localized increased blade root thickness portion is located at a concave side of the blade.

5. The IBR of claim 1, wherein the maximum axial length of the localized increased blade root thickness portion is defined by:

$$\text{Max Length} = 4W\left(1 - \frac{W}{CL}\right);$$

wherein W is the axial thickness of the hub, and CL is the chord length of the blade at the blade root.

6. The IBR of claim 1, wherein the maximum percentage increase in blade thickness at the localized increased blade root thickness portion is defined by:

$$\text{Max Increase } \% = 100\left(1 - \frac{W}{CL}\right)\Big/4;$$

wherein W is the axial thickness of the hub, and CL is the chord length of the blade at the blade root.

7. The IBR of claim 1, wherein the localized increased blade root thickness portion is configured to reduce stress concentrations at the root fillet.

8. A compressor assembly of a gas turbine engine,
comprising one or more compressor rotors arrayed along an engine central longitudinal axis, at least one compressor rotor of the one or more compressor rotors comprising an integrally bladed rotor (IBR) including:
a hub; and
blades, each blade comprising:
an airfoil section extending from a blade root at the hub to a blade tip defining a radially outboard extent of the rotor blade to aerodynamically interact with a flow of air for compressing the air; and
a root fillet integrally formed with the hub and from which the airfoil section integrally extends;
wherein the blade includes a localized increased blade root thickness portion having a maximum axial length and a maximum percentage increase in blade thickness defined as a function of an axial thickness of the hub.

9. The compressor assembly of claim 8, wherein the localized increased blade root thickness portion is located at the blade root.

10. The compressor assembly of claim 8, wherein the localized increased blade root thickness portion is centered on a mid-chord line of the blade.

11. The compressor assembly of claim 8, wherein the localized increased blade root thickness portion is located at a concave side of the blade.

12. The compressor assembly of claim 8, wherein the maximum axial length of the localized increased blade root thickness portion is defined by:

$$\text{Max Length} = 4W\left(1 - \frac{W}{CL}\right);$$

wherein W is the axial thickness of the hub, and CL is the chord length of the blade at the blade root.

13. The compressor assembly of claim 8, wherein the maximum percentage increase in blade thickness at the localized increased blade root thickness portion is defined by:

$$\text{Max Increase } \% = 100\left(1 - \frac{W}{CL}\right)\Big/4;$$

wherein W is the axial thickness of the hub, and CL is the chord length of the blade at the blade root.

14. The compressor assembly of claim 8, wherein the localized increased blade root thickness portion is configured to reduce stress concentrations at the root fillet.

15. A gas turbine engine, comprising:

a turbine driven by products of a combustor; and a compressor operably connected to the turbine and driven by rotation of the turbine, the compressor including an integrally bladed rotor (IBR), the IBR including:

a hub; and blades, each blade comprising:

an airfoil section extending from a blade root at the hub to a blade tip defining a radially outboard extent of the rotor blade to aerodynamically interact with a flow of air for compressing the air; and a root fillet integrally formed with the hub and from which the airfoil section integrally extends;

wherein the blade includes a localized increased blade root thickness portion having a maximum axial length and a maximum percentage increase in blade thickness defined as a function of an axial thickness of the hub.

16. The gas turbine engine of claim 15, wherein the localized increased blade root thickness portion is located at the blade root.

17. The gas turbine engine of claim 15, wherein the localized increased blade root thickness portion is centered on a mid-chord line of the blade.

18. The gas turbine engine of claim 15, wherein the localized increased blade root thickness portion is located at a concave side of the blade.

19. The gas turbine engine of claim 15, wherein the maximum axial length of the localized increased blade root thickness portion is defined by:

$$\text{Max Length} = 4W\left(1 - \frac{W}{CL}\right);$$

wherein W is the axial thickness of the hub, and CL is the chord length of the blade at the blade root.

20. The gas turbine engine of claim 15, wherein the maximum percentage increase in blade thickness at the localized increased blade root thickness portion is defined by:

$$\text{Max Increase } \% = 100\left(1 - \frac{W}{CL}\right)\Big/4;$$

wherein W is the axial thickness of the hub, and CL is the chord length of the blade at the blade root.

* * * * *